US012320094B1

(12) United States Patent
Bainter

(10) Patent No.: US 12,320,094 B1
(45) Date of Patent: Jun. 3, 2025

(54) APPARATUS AND METHOD FOR EXCAVATING A CONE SHAPED PIT

(71) Applicant: Weston Gayle Bainter, Hoxie, KS (US)

(72) Inventor: Weston Gayle Bainter, Hoxie, KS (US)

( * ) Notice: Subject to any disclaimer, the term of this patent is extended or adjusted under 35 U.S.C. 154(b) by 396 days.

(21) Appl. No.: 17/880,983

(22) Filed: Aug. 4, 2022

Related U.S. Application Data

(60) Provisional application No. 63/230,543, filed on Aug. 6, 2021.

(51) Int. Cl.
*E02F 5/20* (2006.01)
*E02D 17/02* (2006.01)

(52) U.S. Cl.
CPC ..... *E02F 5/20* (2013.01); *E02D 17/02* (2013.01)

(58) Field of Classification Search
CPC ..... E02F 17/00; E02F 17/02; E02F 5/20
See application file for complete search history.

(56) References Cited

U.S. PATENT DOCUMENTS 1,956,738 A * 5/1934 Weimer ..... E02F 3/18 37/190
3,132,852 A * 5/1964 Dolbear ..... E21C 41/16 299/5
3,251,449 A * 5/1966 Hoppmann ..... B65G 65/28 198/585
3,258,865 A * 7/1966 Andorf ..... E02F 3/185 37/190
3,893,303 A * 7/1975 Rotter ..... E21D 9/001 405/259.5
5,404,988 A * 4/1995 Königs ..... B65G 63/047 198/588
5,765,965 A * 6/1998 Carter, Jr. et al. ..... E02D 31/00 37/344
6,185,847 B1 * 2/2001 Russell et al. ..... E02F 7/026 37/395
2004/0208710 A1 * 10/2004 Shreider et al. ..... E02F 5/103 405/270

* cited by examiner

*Primary Examiner* — Tara Mayo
(74) *Attorney, Agent, or Firm* — Robert Blinn

(57) ABSTRACT

An excavating apparatus is for making a regular conical pit. The apparatus includes a soil conveyor assembly and a soil excavator assembly. The soil conveyor assembly includes a continuous conveyor belt that extends between a previously excavated center low point and past the edge of the desired conical pit. The soil excavator assembly includes a beam. The lower end of the beam is anchored in a pivoting fashion at the center low point and the upper end of the beam is supported by a wheeled carriage that is able to roll around the periphery of the pit. The beam carries a digging unit that translates along the beam between the edge of the desired pit and the center low point as it pushes excavated soil to the soil conveyor intake. Repeated translations of the digging unit and rotation of the beam around the center point yields a smooth conical pit.

9 Claims, 6 Drawing Sheets

APPARATUS AND METHOD FOR EXCAVATING A CONE SHAPED PIT

CROSS REFERENCES TO RELATED APPLICATIONS

This application claims the benefit of U.S. Provisional Patent Application No. 63/230,543 which was filed on Aug. 6, 2021 and which is incorporated herein by reference in its entirety.

FIELD

This invention relates to an excavator apparatus for excavating a cone shaped pit for providing a substrate for a concrete cone shaped floor under a grain bin.

BACKGROUND

Grain bins that are typically constructed in rural America are round, cylindrical buildings. The sheet metal walls of such grain bins are typically supported by a circular ring concrete foundation. Frequently, especially in dry arears of the country, there is a finished concrete cone under the bin which cannot be seen by external inspection of a finished grain bin. This concrete lined conical pit gives more volume for storing grain and makes it possible to set up an auger that extends down to the lowest center point of the cone shaped pit to facilitate removing substantially all of the grain from the grain bin.

Excavating a cone shaped pit under a grain bin construction site using prior art methods and tools is a very exacting and difficult process. After a rough excavation, workers true out the conical surface using gauges and the like. What is needed is an apparatus and method that can be used is to make a very regular cone shaped pit that is of the correct slope, the correct shape, and that results in the correct thickness of concrete when the concrete is eventually poured to make the regular downwardly sloping walls of the cone shaped pit under the bin.

SUMMARY

Embodiments of the invention are defined by the claims below, not this summary. A high-level overview of various aspects of the invention are provided here for that reason, to provide an overview of the disclosure, and to introduce a selection of concepts that are further described in the Detailed-Description section below. This summary is not intended to identify key features or essential features of the claimed subject matter, nor is it intended to be used as an aid in isolation to determine the scope of the claimed subject matter.

The above stated need is addressed by an excavating apparatus for making a regular conical pit in the ground under a grain bin construction location that is bounded by a circular concrete foundation ring and within which a rough, approximate pit has been previously excavated that is inside the desired surface definition of the desired conical pit and that includes a center low point that is consistent with the desired depth of the desired conical pit. The excavating apparatus includes, a soil conveyor assembly, a soil excavator assembly and a power supply unit.

The soil conveyor assembly includes a continuous conveyor belt that is adapted and positioned for transporting soil from the center low point, up a slope and past the edge of the foundation ring. The soil conveyor includes a drive unit for powering its movement.

The soil excavator assembly includes a beam that has a lower end and an opposite upper end. The lower end of the beam is anchored in a pivoting fashion at the center low point. The upper end of the beam is supported by wheeled carriage that is adapted for rolling movement around the ring foundation. The wheeled carriage includes a drive unit for powering the movement of the wheeled carriage around the ring foundation. The beam carries a digging unit that is able to translate along the beam between the center low point and the inside edge of the ring foundation. The digging unit is positioned and arranged so that it is uniformly offset from the beam and such that it removes soil down to the desired conical profile and further pushes removed soil to the center low point for transport out of the pit by the soil conveyor. The excavator assembly also includes a second drive unit which is at least able to raise the digging unit up the beam from a location that is proximate to the center low point up to a location that is adjacent to the inside edge of the ring foundation.

The power supply unit may be of several types that are well known in the art. The power supply unit could supply electricity for driving electric motors for powering the conveyor, the digging unit and the excavator carriage. Similarly, a power unit that supplies compressed air to air motors could be employed. In the preferred embodiment, the applicant relies on a hydraulic pump unit and hydraulic motors in a fashion that is well known in the art.

DETAILED DESCRIPTION

Figure 1:
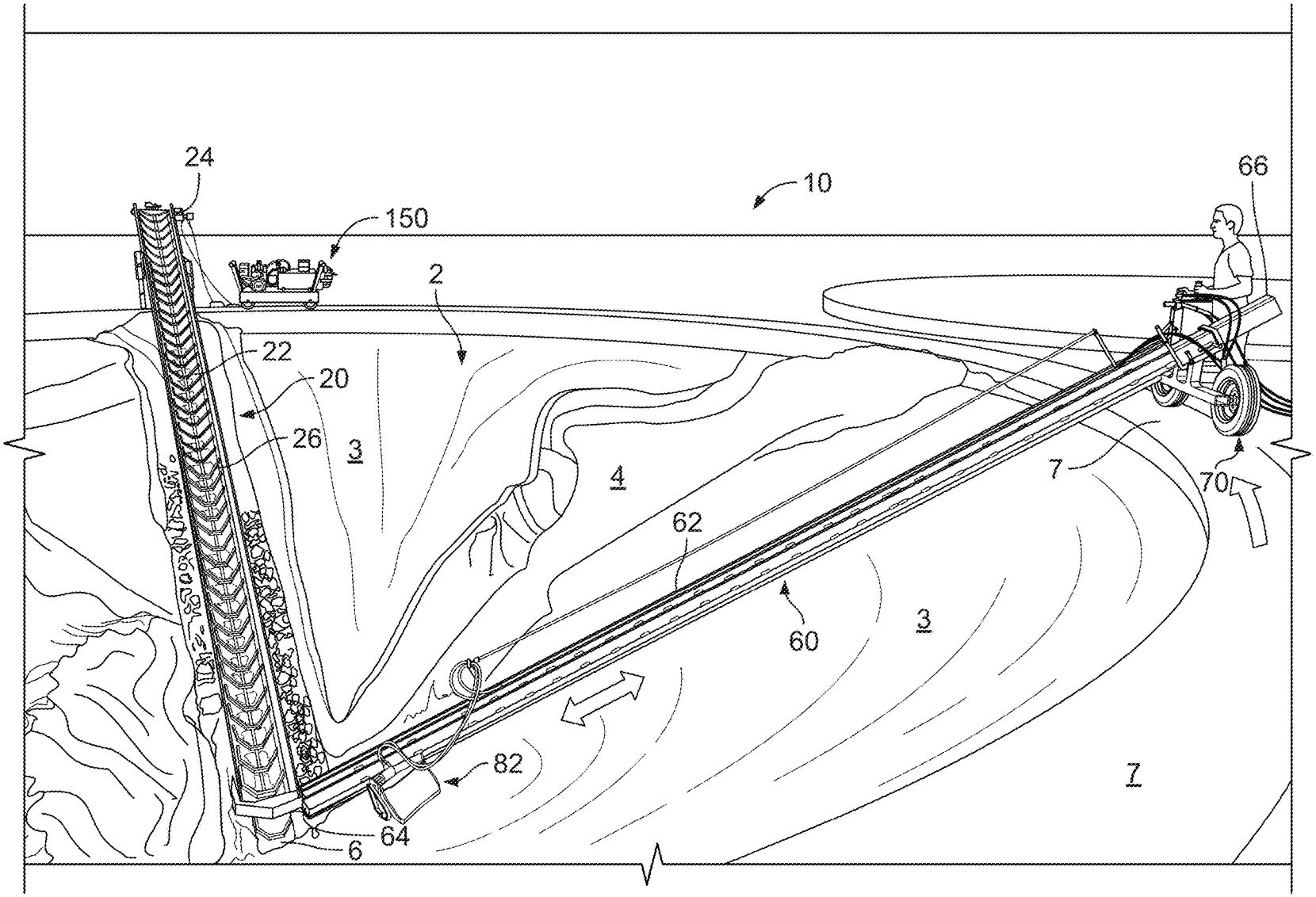
FIG. 1 is a perspective view of an embodiment of an excavation apparatus for excavating a cone shaped pit for a grain bin.

As required, a detailed embodiment of the present invention is disclosed herein; however, it is to be understood that the disclosed embodiment is merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. The drawings constitute a part of this specification and include exemplary embodiment of the present invention and illustrate various objects and features thereof.

Certain terminology will be used in the following description for convenience in reference only and will not be limiting. For example, the words "clockwise" or "upwardly," "downwardly," "rightwardly," and "leftwardly" will refer to directions in the drawings to which reference is made. The words "inwardly" and "outwardly" will refer to directions toward and away from, respectively, the geometric center of the embodiment being described and designated parts thereof. Said terminology will include the words specifically mentioned, derivatives thereof and words of a similar import. The word vertical as used in describing vertical movement should not be understood as perfectly, geometrically vertical, but as being generally upward or downward in direction.

It is to be understood that while certain forms of the present invention have been illustrated and described herein, it is not to be limited to the specific forms or arrangement of parts described and shown. As used in the claims, identification of an element with an indefinite article "a" or "an" or the phrase "at least one" is intended to cover any device assembly including one or more of the elements at issue. Similarly, references to first and second elements is not intended to limit the claims to such assemblies including only two of the elements, but rather is intended to cover two or more of the elements at issue. Only where limiting language such as "a single" or "only one" is used with reference to an element is the language intended to be limited to one of the elements specified, or any other similarly limited number of elements.

Figure 2:
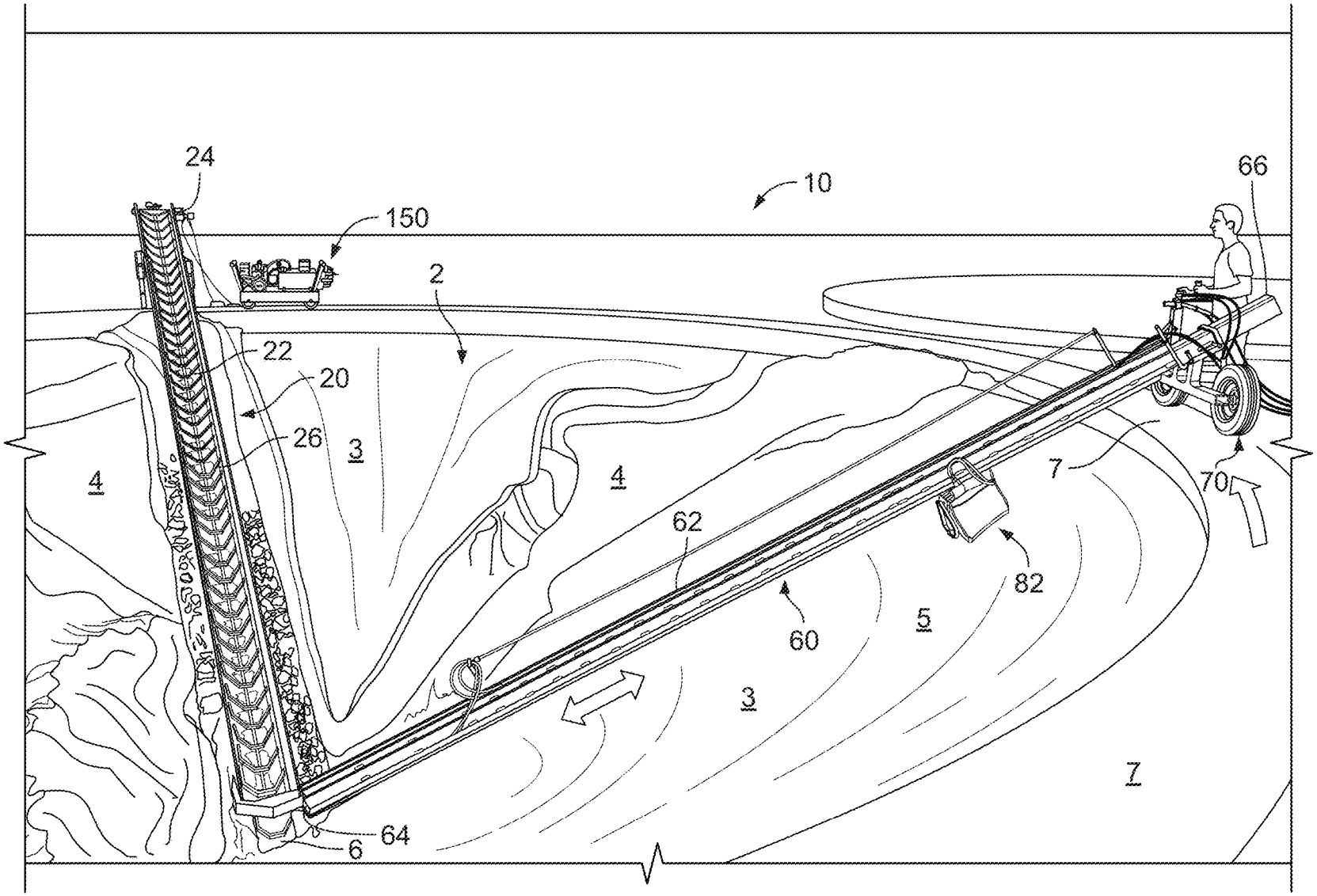
FIG. 2 is a perspective view of an embodiment of an excavation apparatus for excavating a cone shaped pit for a grain bin shown with the digging unit in a fully raised position adjacent to a ring foundation.

Referring to the figures, FIGS. 1 and 2 provide perspective views of an excavator apparatus 10. As can also be seen in FIGS. 1 and 2, excavator apparatus 10 is in position for working the side walls of a pit 2, which when finished will provide a surface for pouring regular concrete conical walls suitable for defining a conical concrete lined cavity beneath a yet to be erected grain bin. Pit 2 has sloping dirt walls 3. As shown in FIGS. 1 and 2, sloping walls 3 include an unfinished portion 4 and a finished portion 5. Sloping walls 3 extend between a center low point 6 and a foundation ring 7 which encircles the upper edge of pit 2. Foundation ring 7 is a level, uniform, level ring of concrete that will later support the circular wall of a grain bin (not shown). As can be further seen in FIGS. 1 and 2, excavator apparatus 10, includes a soil conveyor assembly 20, a soil excavator assembly 60 and a power supply unit 150.

As can be seen in FIGS. 1 and 2, soil conveyor assembly 20 includes a conveyor belt 22 that extends between center low point 6 and a dump location that is outside the periphery of foundation ring 7. Conveyor belt 22 is supported by a structure and includes a drive unit 24. As can be seen in FIGS. 1 and 2, conveyor belt 22 presents a series of upstanding flanges 26 that are suitable for picking up soil at center low point 6 and transferring it to the dump location. Preferably, conveyor belt 22 is fashioned from a flexible rubber material which is rigid enough to render upstanding flanges 26 effective for picking up and moving soil.

Figure 6:
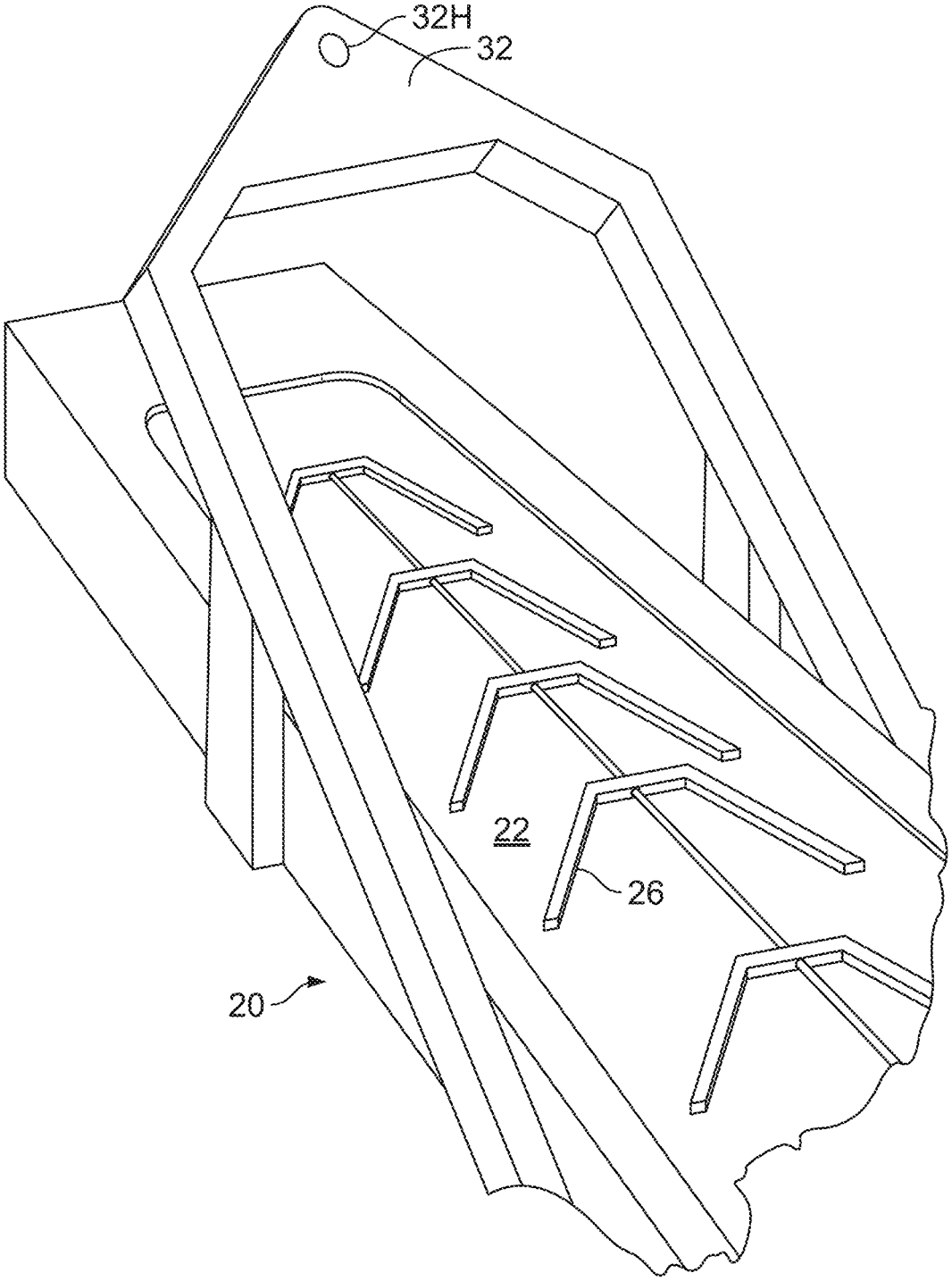
FIG. 6 is perspective view of the bottom end of the soil conveyor assembly.

FIG. 6 is a perspective view of the bottom end of soil conveyor assembly 20. As can be seen in FIG. 6, the bottom end of soil conveyor 20 presents a rigid raised structure 32, which in turn presents a hole 32H. The use of hole 32H will be described in further detail below.

Figure 3:
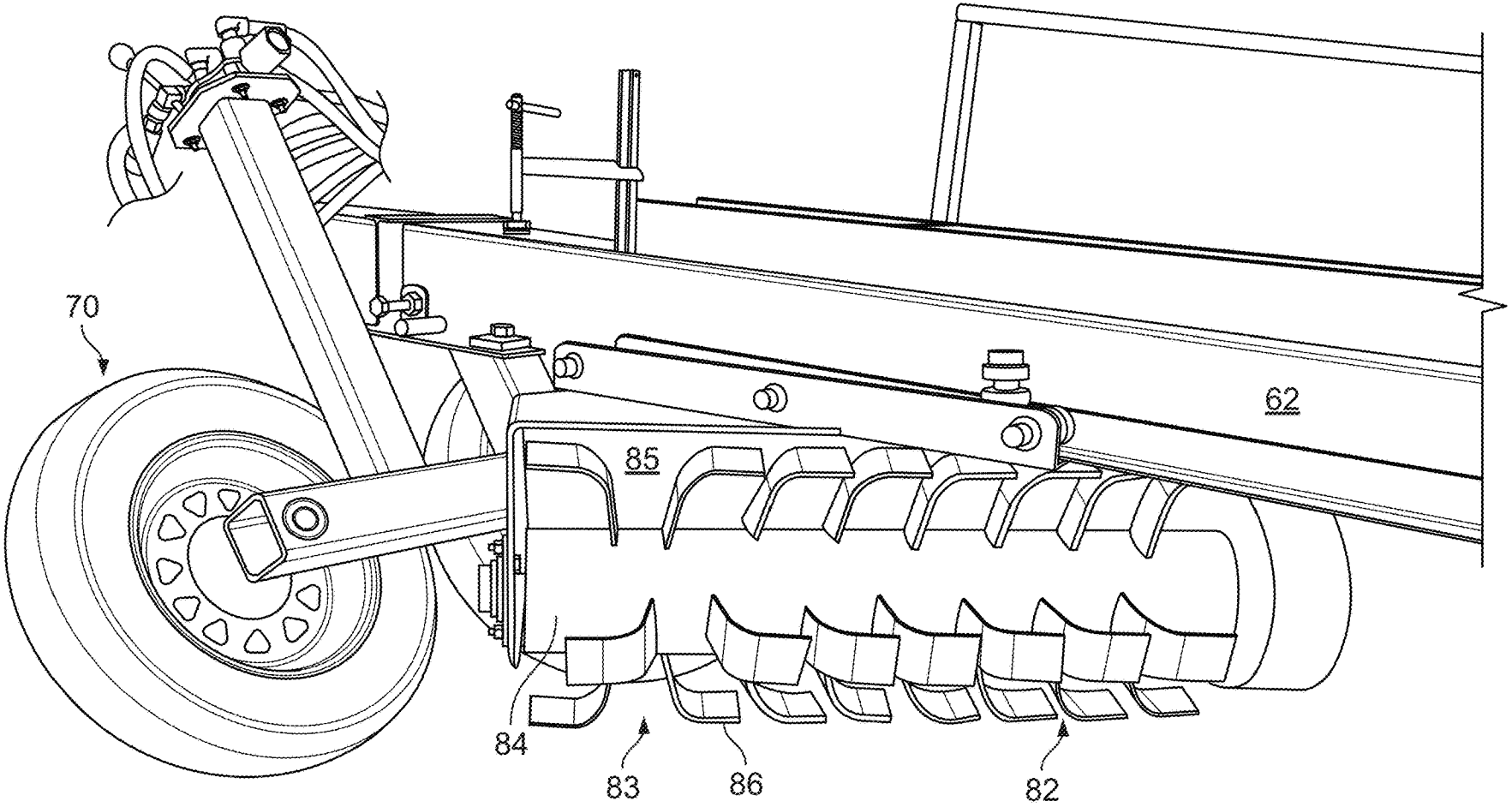
FIG. 3 perspective view of a digging unit of a soil excavator assembly of the excavation apparatus shown in FIG. 1.
Figure 4:
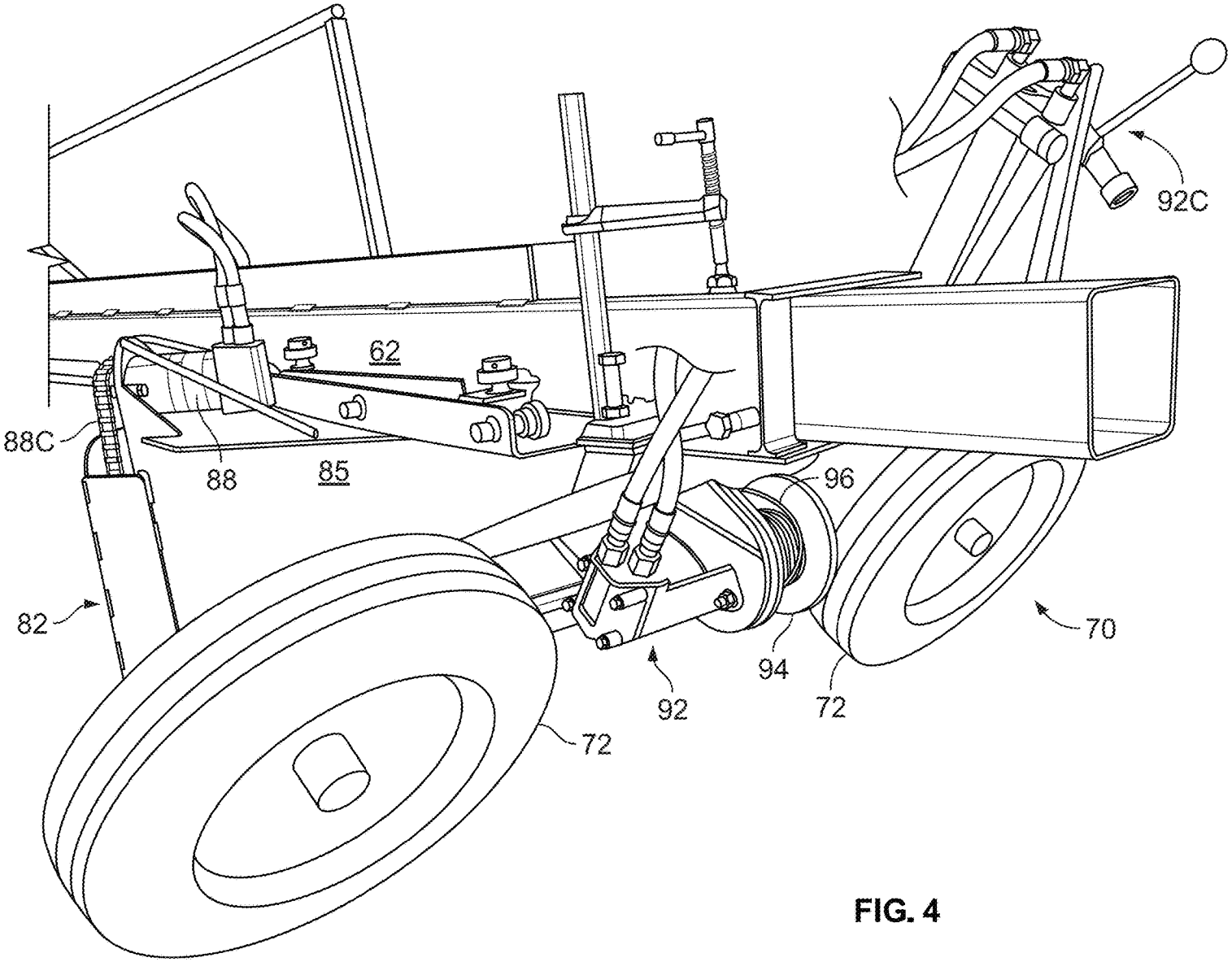
FIG. 4 perspective view of the carriage for carrying the upper end of the beam of the soil excavator assembly.

The soil excavator assembly 60 includes a straight beam 62 that has a lower end 64 and an opposite upper end 66. Lower end 64 of the beam 62 is anchored in a pivoting fashion at center low point 6. Upper end 64 of the beam 62 is supported by wheeled carriage 70 that is adapted for rolling movement around and upon the top surface of ring foundation 7. Both ends beam 62 are supported such that beam 62 maintains a desired constant offset from the desired profile of the desired conical pit between center low point 6 and ring foundation 7. As can be seen in FIG. 4, wheeled carriage 70 includes a pair of spaced wheels 72 that are arranged for riding upon ring foundation 7. As can be seen in FIG. 3, beam 62 carries a digging unit 82 that is able to translate along beam 62 between the center low point 6 and the inside edge of the ring foundation 7.

Figure 5:
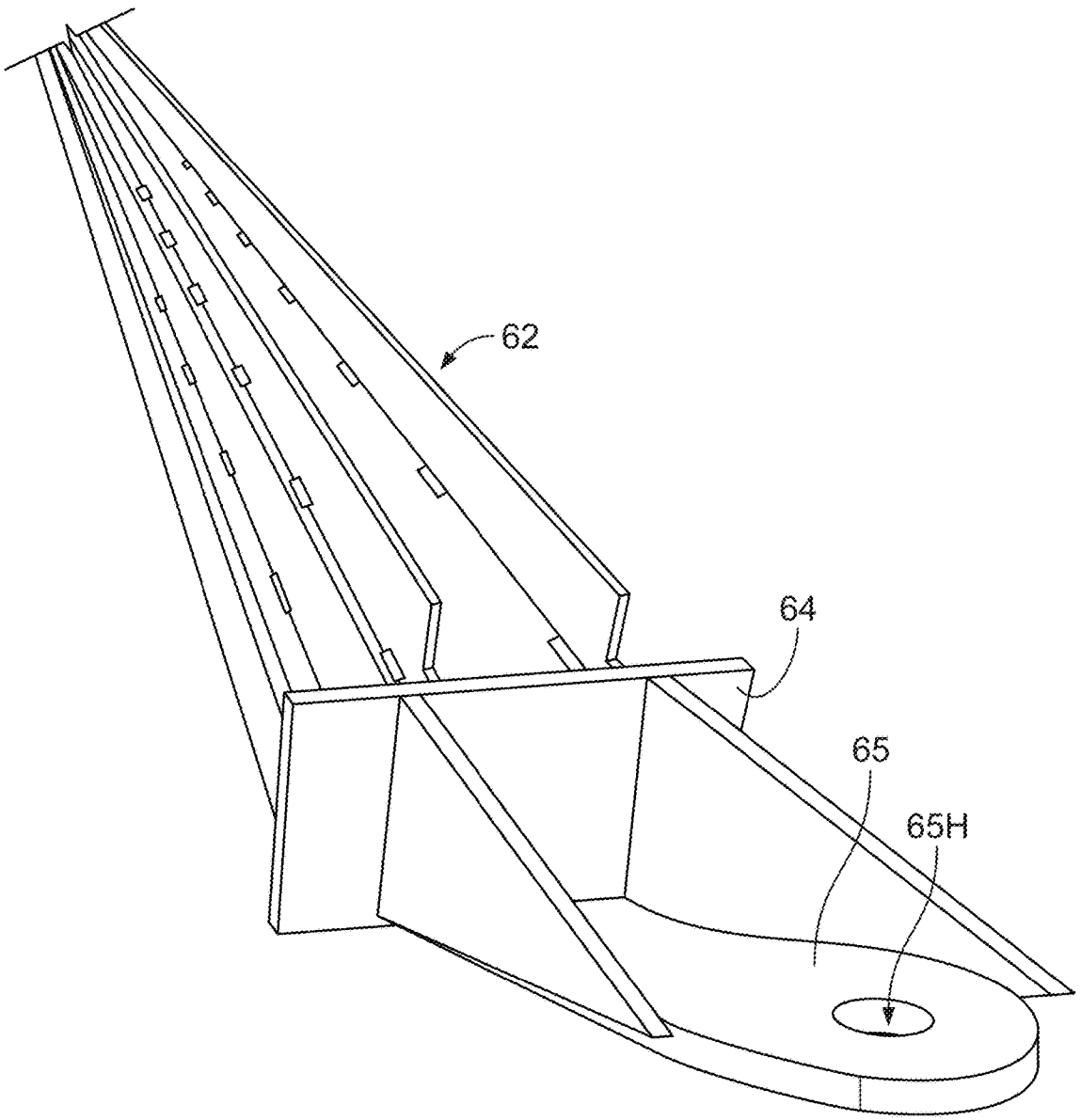
FIG. 5 is perspective view of the bottom end of the beam of the soil excavator assembly showing the lug for connecting to a structure at the lower end of the soil conveyor assembly.

As is shown in FIG. 5, lower end 64 of beam 62 presents a lug 65 that further presents a hole 65H suitable for receiving a pin that is also common to hole 32H in the rigid structure 32 at the lower end of soil conveyor assembly 20. This creates a pivot joint that is fixed directly above center low point 6. This pivot joint arrangement provides a pivot connection that guides the movement of excavator assembly 60 as it swings around conical pit 2.

Digging unit 82 is positioned and arranged so that it is uniformly offset below beam 62 and such that it removes soil down to the desired conical profile as is the case for finished surface 4 shown in FIGS. 1 and 2. Thus, digging unit 62 occupies the offset distance between beam 62 and the desired surface profile so that it's digging action results in a smooth excavation that matches the profile of the desired conical surface. Moreover, digging unit 82 is mounted to beam 62 for translating movement along beam 62 as shown in FIGS. 1 and 2. As digging unit 82 proceeds from upper end 66 to lower end 64 of beam 62, it pushes excavated dirt down to low center point 6 where it is subsequently picked up and removed by conveyor assembly 20. Excavator assembly 60 also includes a drive unit 92 which is, in this example, arranged to drive a winch 94. Winch 94 is adapted for reeling in and playing out a cable 96 which is connected to the frame of digging unit 82. This drive arrangement is able to at least raise digging unit 82 up beam 62 from a location that is proximate to the center low point 6 up to a location that is adjacent to the inside edge of the ring foundation 7. Gravity can be used to power the progression of digging unit 82 from ring foundation 7 to center low point 6. An alternative drive for powering digging unit 82 up and down beam 62 would be to have winch 94 and hydraulic motor 92 to be powered in both directions and have cable 96 arranged in a complete loop that encircles at least most of the length of beam 62 and which is also fixed to digging unit 82 whereby digging unit 82 would be powered in both directions to move up and down beam 62. In this example, motor 92 is a hydraulic motor. As the skilled reader can see in FIG. 4, controls 92C are provided for an operator (illustrated in FIGS. 1 and 2) to control the operation of motor 92 and winch 94.

As can be seen in FIG. 3, digging unit 82 includes a digging assembly 83 which includes a shaft 84 that carries plurality of tines 86. In this example, shaft 84 is powered to rotate by a hydraulic motor 88 (indicated in FIG. 4) which is connected to shaft 84 by a chain 88C. Hydraulic motor 88 could also be a pneumatic motor or an electric motor. The rotation direction of digging unit 82 is such that tines 86 on the bottom are rotating toward the vantage point of a viewer in FIG. 3 and toward the center low point. The applicants believe that digging unit may rotate at between 30 and 100 RPM but has found 60 RPM appears to be optimal. This action pushes excavated soil toward center low point 6 and the intake of conveyor assembly 20 at that location. Digging unit 82 also includes a back shroud 85 which surrounds digging assembly 83 from above and behind. Shroud 85 has a straight lower trailing edge that generally conforms with the desired grade of the excavated path created by digging unit 82 as it passes from the top of pit 2 to the bottom of pit 2.

Power supply unit 120 may be one of several types that are well known in the art. Power supply unit 120 could supply electricity for driving electric motors for powering the various devices noted above. Similarly, a power unit that supplies compressed air to air motors could be employed. The applicant has chosen to use at least one hydraulic pump unit and hydraulic motors to power conveyor belt 22 of soil conveyor assembly 20, and hydraulic motor 88 of digging unit 82 as well as hydraulic motor 92 that powers winch 94 (shown in FIG. 4) of digging unit 82 in a fashion that is well known in the art. Typically, power supply unit 120 could be a hydraulic pump unit that is powered by an internal combustion engine and which is suitable for supplying pressurized hydraulic fluid to both soil conveyor assembly 20 and soil excavator assembly 60. However, in order to supply hydraulic fluid to soil excavator assembly 60, during its incremental progression around pit 2, a lengthy hydraulic line capable of spanning at least the diameter of pit 2 or perhaps even half the circumference of pit 2 would be required. Accordingly, optionally, carriage 60 of soil excavator assembly 60 may also carry a hydraulic pump (not shown) which could be powered by an internal combustion engine (not shown). In any case, significant amounts of power will be required to power the various operations described above.

The method for employing excavating apparatus 10 will be easily understood by those skilled in the art, especially by referring to FIG. 1. To make an accurate, conical pit suitable for receiving poured concrete for a cone shaped concrete lined pit within the confines of a ring foundation 7, it is preferable to execute the following steps in the following order: (a) Excavate a rough and approximate pit defined by unfinished surface 4 that also includes the accurately located low center point 6. (b) Excavate a trench that extends from low center point 6 to the inside edge of the ring foundation such that the floor of the trench generally conforms to the desired cone surface. The remainder of the inside rough unfinished surface 4 should be such that no considerable part of unfinished surface 4 extends past the desired conical profile. That is, ideally, all portions of unfinished surface 4 is above or inside that desired conical profile. (c) Mount soil conveyor assembly 20 in the excavated trench created in step (b). Mount soil excavator assembly 60 as shown in FIGS. 1 and 2, but as close as possible to soil conveyor assembly 20. (c) Activate both Soil conveyor assembly 20 and soil excavator assembly 60. (d) Operate soil excavator assembly 60 so that digging unit 82 proceeds from a first upper location adjacent to ring foundation 7 to second lower location that is adjacent to low center point 6 as it pushes excavated soil to the intake end of soil conveyor assembly 20 at low center point 6. (e) Return digging unit 82 to its position adjacent to ring foundation 7 and repeat step (d) if necessary or move on to the next step. (f) Advance carriage 70 by a distance not greater than the width of digging unit 82 and repeat step (d). (g) Repeat steps (d), (e) and (f) around ring foundation 7 until surface 3 has been transformed from an unfinished surface 4 to a finished surface 5. After all of the above steps have been executed, finished surface 5 is now in a condition suitable for pouring a uniform layer of concrete.

The skilled reader will appreciate that it may be difficult to operate excavator assembly 60 in close angular proximity with conveyor assembly 20. Thus, when executing the above steps, it may be necessary to reposition conveyor assembly 20 so that excavator assembly 60 may be swept through the portion of the arc that occupied by conveyor assembly 20 before repositioning.

Many different arrangements of the various components depicted, as well as components not shown, are possible without departing from the scope of the claims below. Embodiments of the technology have been described with the intent to be illustrative rather than restrictive. Alternative embodiments will become apparent to readers of this disclosure after and because of reading it. Alternative means of implementing the aforementioned can be completed without departing from the scope of the claims below. Certain features and sub-combinations are of utility and may be employed without reference to other features and sub-combinations and are contemplated within the scope of the claims.

Having thus described the invention, what is claimed as new and desired to be secured by Letters Patent is:

1. An excavating apparatus for making a regular conical pit in the ground within which a rough, approximate pit has been previously excavated having a roughly conical surface that is inside the desired conical surface definition of the desired conical pit and a wherein the pit also includes a center low point that is consistent with the desired depth of the desired conical pit, and wherein the pit is surrounded by a generally flat upper edge, the excavating apparatus comprising:

an elongated soil conveyor assembly including a continuous conveyor belt that is arranged for transporting excavated soil from the center low point, to the upper edge of the pit where the excavated soil is ejected from the pit, a soil excavator assembly including a beam that has a lower end and an opposite upper end, the lower end of the beam being anchored in a pivoting fashion at the center low point, the upper end of the beam being supported by wheeled carriage that is adapted for rolling movement around the upper edge of the pit, the beam carrying a digging unit that is able to translate along the beam between the inside edge of the ring foundation and the center low point, whereby soil that is excavated by the digging unit is moved to the center low point where the excavated soil is received by the soil conveyor assembly for transport and ejection from the pit.

2. The excavating apparatus of claim 1, wherein:

the soil conveyor assembly is supported by an elongated structure and the conveyor assembly is disposed in a trench that extends from the center low point of the pit to the upper edge of the pit.

3. The excavating apparatus of claim 2, wherein:

the elongated structure of the soil conveyor assembly includes a portion at the lower end thereof that presents a hole that generally aligns with the center low point of the pit and wherein the lower end of the beam of the soil excavator also presents a hole for receiving a pin for pivotably connecting the soil excavator to the soil conveyor assembly such that the beam of the soil excavator is able to rotate around the center low point so that the excavator assembly may be moved around the pit in an incremental fashion.

4. The excavating apparatus of claim 1, further comprising:

a power unit for supplying power to the soil conveyor assembly and the soil excavator assembly.

5. The excavating apparatus of claim 1, further comprising:

a power unit that is a hydraulic power unit for supplying pressurized hydraulic fluid to a hydraulic motor that powers the soil conveyor assembly and at least one hydraulic motor that powers the digging unit of the soil excavator assembly.

6. A method for excavating a cone shaped pit suitable for locating under a grain bin, comprising the following steps:

(a) excavating an approximate cone shaped pit having a center low point and an upper circular boundary that defines a generally circular upper edge, (b) situating a soil conveyor having an elongated powered conveyor belt such that the soil conveyor extends from the center low point of the pit to the upper edge of the pit, (c) obtaining a soil excavator that includes an elongated beam that is able to be pivotably secured at center low point and which is supported by a carriage that is arranged to be able to move around the upper edge of the pit in an incremental fashion, the soil excavator further including a digging unit that is able excavate soil and is able to move up and down the elongated beam, and, (d) activating the soil conveyor such that the soil conveyor is operable to receive soil at the center low point and convey such soil up to the edge of the pit thereby removing such excavated soil from the pit, (e) positioning the digging unit of the soil excavator at the edge of the pit, (f) activating soil excavator such that the digging unit proceeds down the elongated beam to the center low point as it excavates a generally smooth regular portion of a desired conical profile, whereby the digging unit is able to excavate soil and move the excavated soil to the center low point such that the soil conveyer is able to receive the excavated soil at the center low point and convey the excavated soil to the edge of the pit for removal from the pit, (g) returning the digging unit to the upper end of the elongated beam adjacent to the edge of the pit, (h) moving the carriage of the soil excavator to a new position that is next to the previous position, (i) repeating steps (f) through (h) until the entirety of the surface of the pit has been excavated to form a pit with the desired cone shaped surface.

7. The method of claim 6, further comprising the step of: after step (a), making a cement ring around the edge of the pit.

8. The method of claim 7, further comprising the step of: after step (a) making a cement ring around the edge of the pit and digging a trench that extends from the center low point to the edge and situating the soil conveyor in the trench in step (c).

9. The method of claim 6, further comprising the step of: after step (a) digging a trench that extends from the center low point to the edge and situating the soil conveyor in the trench in step (c).

* * * * *